US010050388B2

(12) United States Patent
Ito et al.

(10) Patent No.: US 10,050,388 B2
(45) Date of Patent: Aug. 14, 2018

(54) CONNECTOR HAVING A SHORTING TERMINAL WITH A PAIR OF PRESS-FIT PROJECTIONS

(71) Applicant: Sumitomo Wiring Systems, Ltd., Yokkaichi, Mie (JP)

(72) Inventors: Toshihiro Ito, Mie (JP); Yutaka Noro, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/557,898

(22) PCT Filed: Feb. 26, 2016

(86) PCT No.: PCT/JP2016/055736
§ 371 (c)(1),
(2) Date: Sep. 13, 2017

(87) PCT Pub. No.: WO2016/147833
PCT Pub. Date: Sep. 22, 2016

(65) Prior Publication Data

US 2018/0076576 A1 Mar. 15, 2018

(30) Foreign Application Priority Data

Mar. 18, 2015 (JP) ..... 2015-054278
Sep. 24, 2015 (JP) ..... 2015-186453

(51) Int. Cl.
*H01R 13/703* (2006.01)
*H01R 13/64* (2006.01)
*H01R 13/639* (2006.01)

(52) U.S. Cl.
CPC ..... *H01R 13/7031* (2013.01); *H01R 13/639* (2013.01); *H01R 13/64* (2013.01)

(58) Field of Classification Search
CPC ..... H01R 13/7032; H01R 13/7031; H01R 13/639; H01R 13/64
(Continued)

(56) References Cited

U.S. PATENT DOCUMENTS 5,647,754 A * 7/1997 Kohno ..... H01R 13/7032 200/51.1
5,788,520 A * 8/1998 Roche ..... H01R 13/7032 200/51.1
(Continued)

FOREIGN PATENT DOCUMENTS

EP 0923169 A1 6/1999
EP 2012394 A1 1/2009
(Continued)

OTHER PUBLICATIONS

International Search Report dated May 24, 2016.
European Search Report dated Nov. 27, 2017.

*Primary Examiner* — Harshad C Patel
(74) *Attorney, Agent, or Firm* — Gerald E. Hespos; Michael J. Porco; Matthew T. Hespos

(57) ABSTRACT

It is aimed to provide a connector capable of reliably suppressing rattling by both of a pair of press-fit projections entering one press-fit groove. A connector includes a shorting terminal (10) configured to short a pair of terminal fittings (T) by resilient contact pieces (11) resiliently contacting the pair of terminal fittings (T), and a housing (30) configured to accommodate the terminal fittings (T) and the shorting terminal (10). The shorting terminal (10) includes a pair of press-fit projections (20) to be press-fit into one press-fit groove (36) provided in the housing (30) and separated on front and rear sides in a press-fitting direction into the press-fit groove (36). The pair of press-fit projections (20) are formed such that a height of the press-fit projection located on the front side in the press-fitting
(Continued)

direction is smaller than that of the press-fit projection located on the rear side.

8 Claims, 17 Drawing Sheets

(58) Field of Classification Search
USPC ..... 439/188
See application file for complete search history.

(56) References Cited

U.S. PATENT DOCUMENTS

| | | | | |
|---|---|---|---|---|
| 5,803,756 | A * | 9/1998 | Furutani | H01R 13/7032 200/51.1 |
| 6,171,124 | B1 | 1/2001 | Kojima | |
| 6,575,775 | B2 * | 6/2003 | Hasegawa | H01R 13/41 439/188 |
| 7,618,274 | B2 * | 11/2009 | Nakamura | H01R 13/641 439/188 |
| 7,850,471 | B2 * | 12/2010 | Imai | H01R 29/00 200/51.1 |
| 2004/0072464 | A1 | 4/2004 | Nakamura | |
| 2004/0214470 | A1 | 10/2004 | Hori | |
| 2005/0074997 | A1 * | 4/2005 | Nakamura | H01R 13/7032 439/188 |
| 2009/0011658 | A1 | 1/2009 | Shibata et al. | |
| 2015/0140846 | A1 * | 5/2015 | Kanemura | H01R 13/7032 439/188 |

FOREIGN PATENT DOCUMENTS

| | | |
|---|---|---|
| JP | 8-130071 | 5/1996 |
| JP | 10-302901 | 11/1998 |
| JP | 11-176522 | 7/1999 |
| JP | 2004-134259 | 4/2004 |
| JP | 2004-327321 | 11/2004 |
| JP | 2005-32630 | 2/2005 |
| JP | 2005-108771 | 4/2005 |
| JP | 2008-97908 | 4/2008 |
| JP | 2009-16148 | 1/2009 |

* cited by examiner

CONNECTOR HAVING A SHORTING TERMINAL WITH A PAIR OF PRESS-FIT PROJECTIONS

BACKGROUND

Field of the Invention

The present invention relates to a connector.

Description of the Related Art

Conventionally, a connector is known which is provided with a shorting terminal for shorting between a pair of terminal fittings by contacting those terminal fittings. This shorting terminal includes a resilient contact piece capable of resiliently contacting the terminal fittings. In a state where a mating connector is not connected, the resilient contact piece contacts corresponding terminal fittings to short between the terminal fittings. When the mating connector is connected, the resilient contact piece is separated from the terminal fittings by a short releasing portion provided in the mating connector to release a shorted state of the terminal fittings.

For example, in a connector described in Japanese Unexamined Patent Publication No. 2004-134259, a shorting terminal is accommodated into a shorting terminal accommodation chamber provided in a housing from front. A laterally long plate-like body portion of the shorting terminal is press-fit and held in grooves formed on both side edges of the upper end of the shorting terminal accommodation chamber.

In the connector as described above, it is thought to provide projections on parts of the body portion of the shorting terminal to be press-fit into the grooves of the shorting terminal accommodation chamber in order to prevent the shorting terminal from rattling in a displacement direction of the resilient contact piece. At that time, if a pair of projections are provided on front and rear sides, the groove is pushed and widened by the projection first entering the groove of the housing and the later entering projection may not be able to sufficiently suppress rattling due to a clearance formed between the groove and this projection or the like.

The present invention was completed based on the above situation and aims to provide a connector capable of reliably suppressing rattling by both of a pair of press-fit projections entering one press-fit groove.

SUMMARY

A connector of the present invention includes a shorting terminal and a housing. The shorting terminal has a resilient contact piece configured to short a pair of terminal fittings by the resilient contact piece resiliently contacting the pair of terminal fittings. The housing is configured to accommodate the terminal fittings and the shorting terminal The shorting terminal includes two press-fit projections to be press-fit into one press-fit groove provided in the housing. The press-fit projections are separated on front and rear sides in a press-fitting direction into the press-fit groove, and the press-fit projections are formed so that a height of the press-fit projection located on the front side in the press-fitting direction is smaller than that of the press-fit projection located on the rear side.

According to the present invention, even if the press-fit groove is pushed and widened by the press-fit projection first entering the press-fit groove, the formation of a clearance between the later entering press-fit projection and the press-fit groove can be prevented. Thus, both of the press-fit projections entering one press-fit groove can reliably suppress rattling.

The press-fit projection located on the rear side in the press-fitting direction may be arranged near a contact portion of the resilient contact piece configured to contact the terminal fittings. According to this configuration, since rattling can be prevented reliably near the contact portion of the resilient contact piece by increasing the height of the press-fit projection located on the rear side in the press-fitting direction, the rattling of the shorting terminal can be suppressed effectively.

The shorting terminal may include a base plate in the form of a flat plate having the press-fit projections, and a rising portion rising in a direction intersecting with the press-fitting direction from a rear end of the base plate in the press-fitting direction. The rising portion may be inclined so that a rising end is located more forward than a base plate side in the press-fitting direction. According to this configuration, the shorting terminal can be accommodated into the housing by pressing the end part of the rising portion on the base plate side with a jig. The end part of the rising portion on the base plate side is difficult to deform even if pressed by the jig. Thus, the push-in amount of the shorting terminal can be controlled easily. In addition, a pressing force of the jig efficiently acts on the base plate. Therefore, the press-fit projections provided on the base plate can be press-fit efficiently. Further, there is conventionally known a shorting terminal in which a box to be pressed by a jig is provided to surround a resilient contact piece. However, material cost can be reduced since the shorting terminal of the invention does not need a box.

The housing may include a shorting terminal accommodation chamber configured to accommodate the shorting terminal, and a recess may be provided on a rear end part of the shorting terminal accommodation chamber in the press-fitting direction to correspond to an end part of the rising portion on the base plate side. I If no recess is formed on the rear end part of the shorting terminal accommodation chamber in the press-fitting direction, a tip part of the jig easily contacts a wall surface of the shorting terminal accommodation chamber and it could be difficult to bring the jig into contact with the end part of the rising portion on the base plate side. However, the tip part of the jig can enter the recess according to the above configuration, and the end part of the rising portion on the base plate side can be pressed reliably.

The rising portion may be at a side of the resilient contact piece opposite to a side to be brought into contact with the terminal fittings and may prevent excessive deflection of the resilient contact piece. According to this configuration, the rising portion has an excessive deflection prevention function. Thus, the shape of the shorting terminal can be simplified as compared to the case where an excessive deflection preventing portion is provided separately provided in the shorting terminal.

The shorting terminal may include a projecting piece projecting on the base plate and to be inserted into the press-fit groove. A front edge in the press-fitting direction, out of a peripheral edge of the projecting piece contacts a back end of the press-fit groove to position the shorting terminal. Thus, the front edge of the projecting piece is inclined so that an end on a projecting end side is located more forward than an end on the base plate side in the press-fitting direction. According to this configuration, the front edge of the projecting piece contacts the back end of the press-fit groove to position the shorting terminal. Thus, the shorting terminal can be positioned accurately since a point of contact is clear, for example, as compared to the case where the entire front edge of the projecting piece comes into contact with the back end of the press-fit groove.

The shorting terminal may include a projecting piece projecting on the base plate and to be inserted into the press-fit groove, and a back end of the press-fit groove is inclined so that an outer end in a width direction of the shorting terminal accommodation chamber is located more forward than an inner end in the press-fitting direction. According to this configuration, the projecting piece is less likely to be separated from the back end of the press-fit groove. Thus, the shorting terminal will not be inserted beyond a proper accommodation position (where the push-in amount of the shorting terminal becomes excessive).

DETAILED DESCRIPTION

First Embodiment

A first specific embodiment of the present invention is described in detail with reference to FIGS. 1 to 12.

Figure 1:
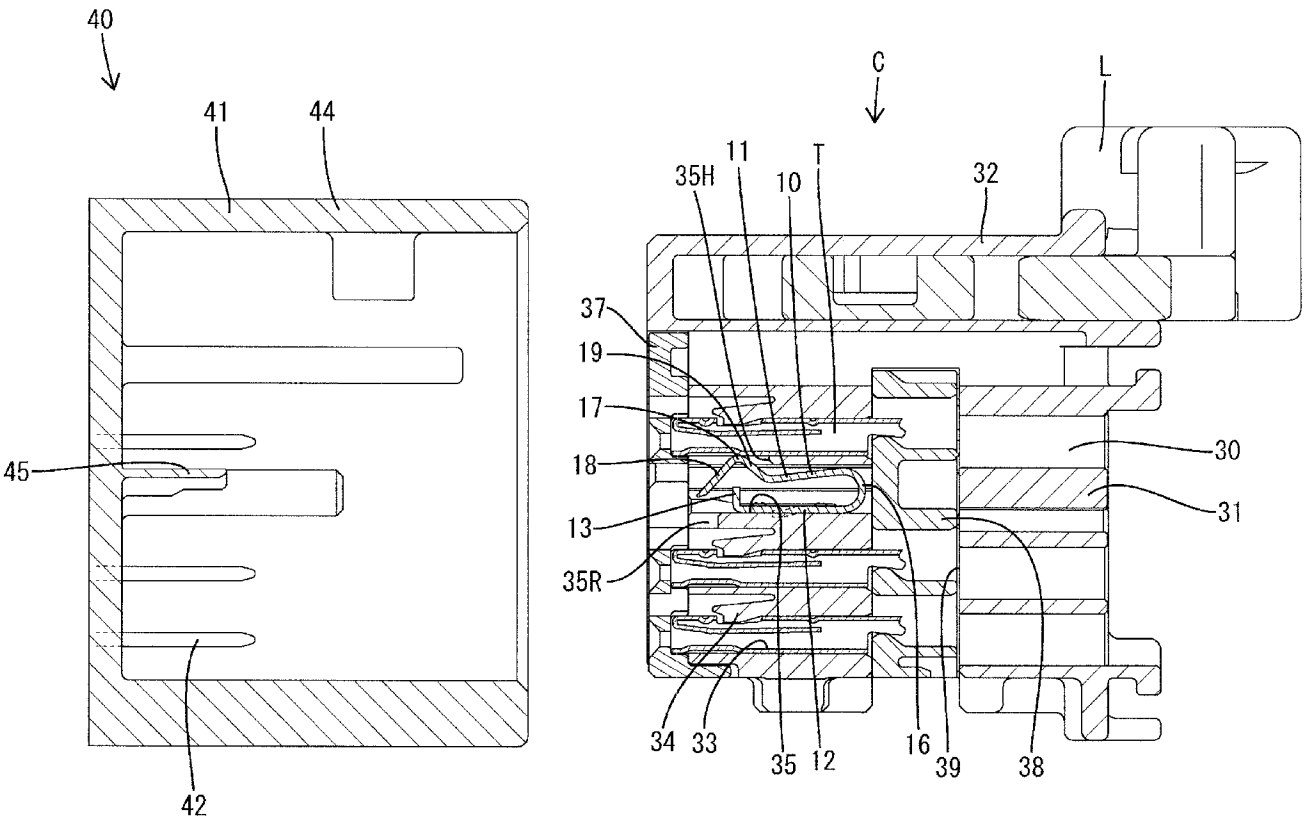
FIG. 1 is a section showing a connector in a first embodiment in a state before being connected to a mating connector.

A connector C in the first embodiment is connected to an ECU for an airbag or the like by being connected to a mating connector 40. In the following description, in each constituent member, connection surface sides of the both connectors C, 40 are respectively referred to as front sides and upper and lower sides of FIG. 1 are referred to as front and rear sides.

The mating connector 40 includes a housing (hereinafter, referred to as a mating housing 41) made of synthetic resin, and a plurality of male terminal fittings (hereinafter, referred to as mating terminal fittings 42). The mating housing 41 includes a receptacle 44 open forward, and the connector C is fit into this receptacle 44. The mating terminal fittings 42 are mounted in the mating housing 41 such that tip parts thereof project toward a connection side. Further, the mating housing 41 is provided with short releasing portions 45 projecting toward the connection side. The short releasing portion 45 releases a shorted state of female terminal fittings T and a shorting terminal 10 held in the connector C in the process of connecting the connector C.

The connector C includes a plurality of terminal fittings T, shorting terminals 10 each for shorting a pair of adjacent terminal fittings T and a housing 30 for accommodating the terminal fittings T and the shorting terminals 10.

Figure 4:
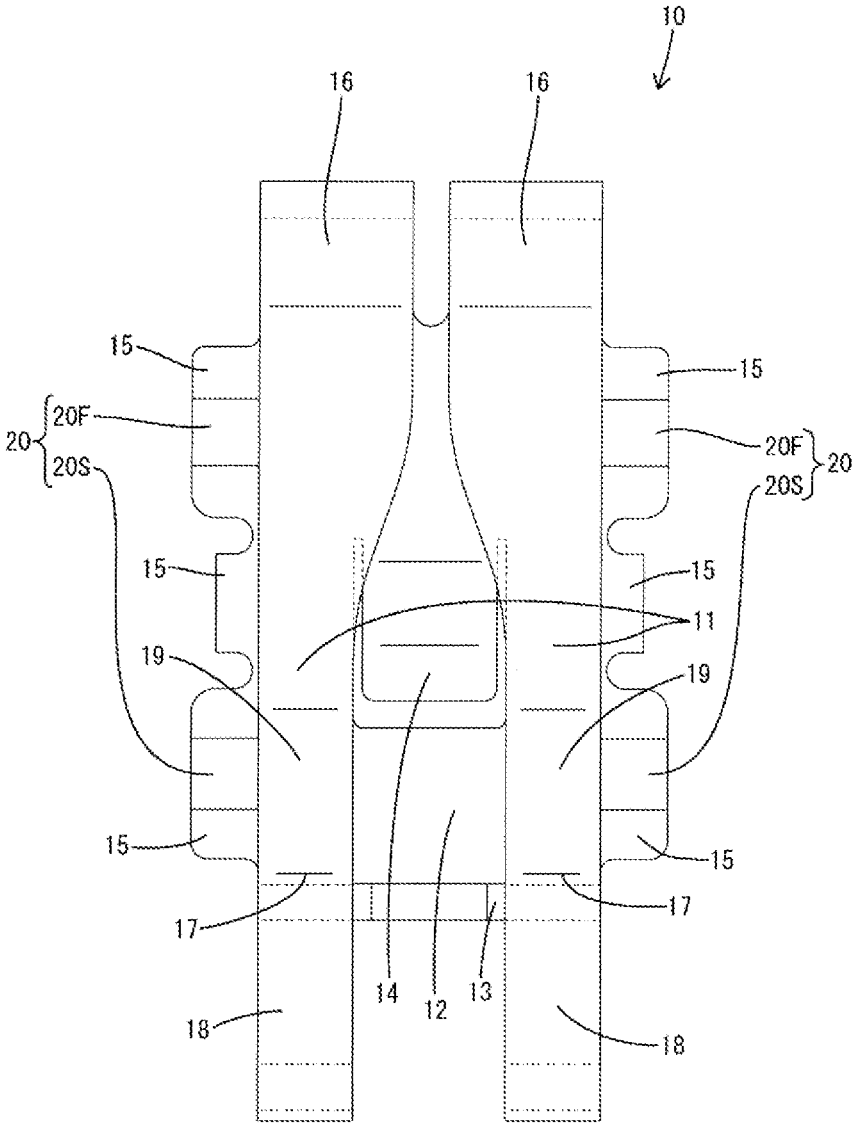
FIG. 4 is a plan view of the shorting terminal.
Figure 5:
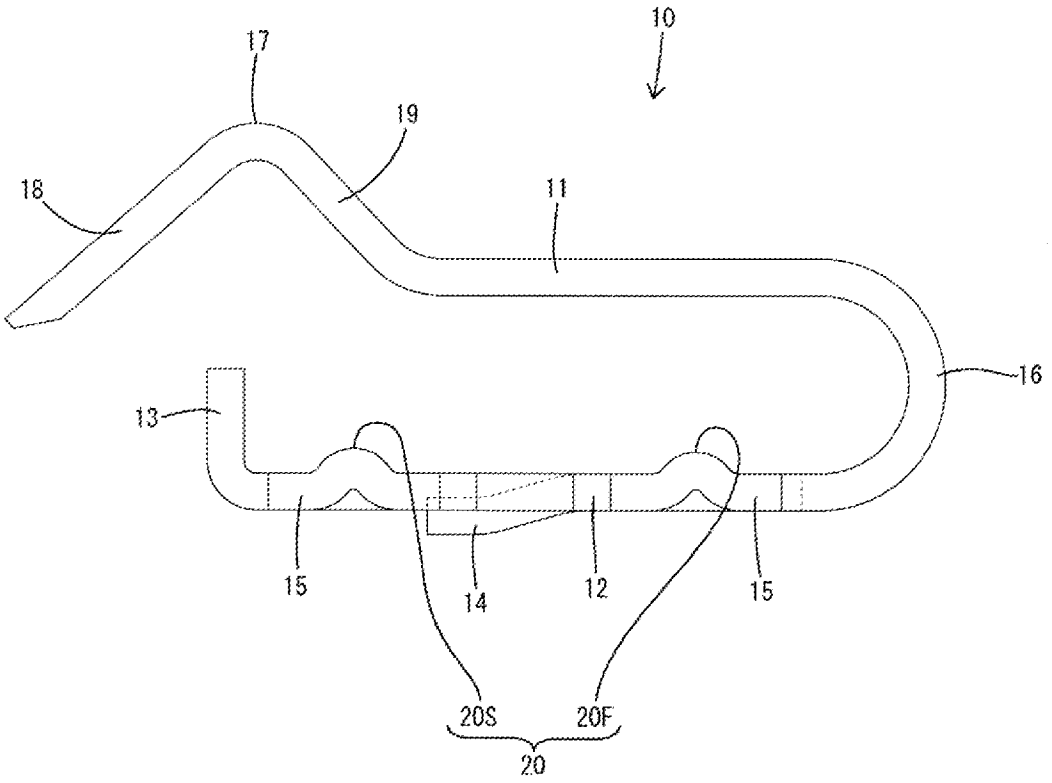
FIG. 5 is a side view of the shorting terminal.
Figure 6:
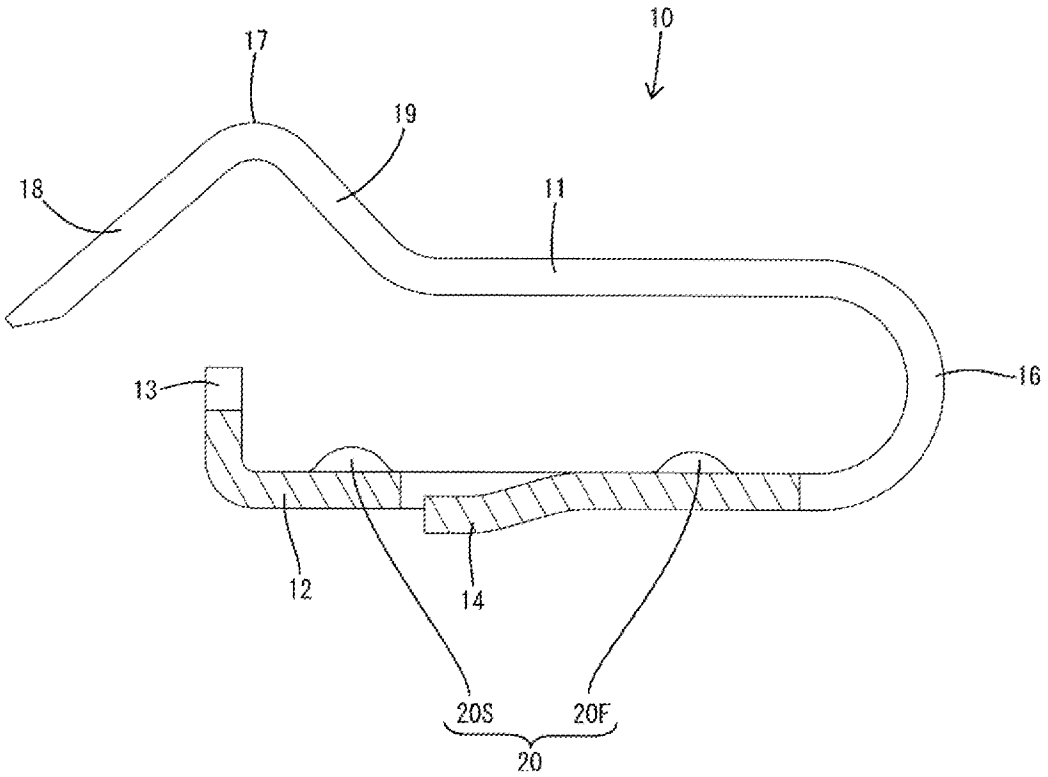
FIG. 6 is a section, corresponding to a cross-section at position A-A of FIG. 3, showing the shorting terminal.

The shorting terminal 10 is formed by press-working a conductive metal plate and includes, as shown in FIGS. 4 and 5, a base plate 12 substantially in the form of a flat plate and a pair of resilient contact pieces 11 folded from the rear end of the base plate 12 and extending forward. The shorting terminal 10 shorts the pair of terminal fittings T by the pair of resilient contact pieces 11 resiliently contacting the pair of terminal fittings T.

The base plate 12 has a rectangular shape slightly longer in a front-rear direction as a whole, and an excessive deflection preventing wall 13 for preventing excessive deflection and deformation of the pair of resilient contact pieces 11 is erected on the front end thereof. Further, a locking piece 14 to be locked to the housing 30 and cantilevered forward is formed in a central part of the base plate 12 by cutting and raising to extend obliquely down.

As shown in FIG. 4, a plurality of projecting pieces 15 are provided on both left and right sides of the base plate 12. The projecting pieces 15 are provided on both front and rear end parts and an intermediate part of the base plate 12. The projecting pieces 15 enter press-fit grooves 36 of the housing 30 when the shorting terminal 10 is accommodated into a shorting terminal accommodation chamber 35 shown in FIG. 9. The projecting pieces 15 provided on the both front and rear end parts of the base plate 12 have larger dimensions than those provided on the intermediate part in a projecting direction (lateral direction) and the front-rear direction. Press-fit projections 20 to be press-fit into the press-fit grooves 36 of the housing 30 are provided on the projecting pieces 15 provided on the both front and rear end parts of the base plate 12. The press-fit projections 20 are described in detail later.

The resilient contact piece 11 is resiliently deflectable in a vertical direction with a folded portion 16 coupled to the base plate 12 as a supporting point. A deflection space for allowing the resilient contact piece 11 to be deflected and deformed is formed between the resilient contact piece 11 and the base plate 12.

As shown in FIG. 5, a front end part of the resilient contact piece 11 is bent into a substantially chevron shape, and the top thereof serves as a contact portion 17 capable of contacting the lower surface of the terminal fitting T. Note that a part before the contact portion 17 serves as a descending portion 18 inclined downwardly to the front and a part behind the contact portion 17 serves as an ascending portion 19 inclined upwardly to the front.

As shown in FIG. 4, the resilient contact piece 11 has a larger width on the side of the folded portion 16 than on the side of the contact portion 17 and is widened inwardly to gradually increase the width behind the ascending portion 19.

Figure 7:
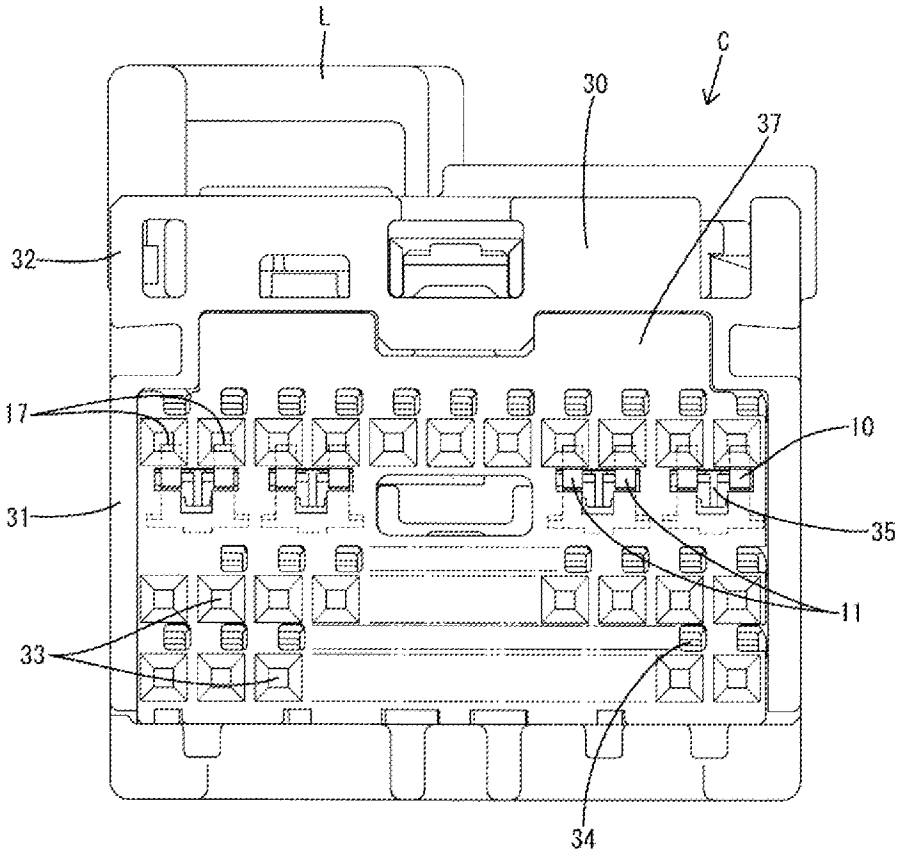
FIG. 7 is a front view of the connector.

As shown in FIG. 7, the housing 30 includes a terminal accommodating portion 31 for accommodating the terminal fittings T and the shorting terminals 10 and a lever accommodating portion 32 for accommodating a lever L, and is substantially in the form of a rectangular block fittable into the receptacle 44 of the mating housing 41.

The terminal accommodating portion 31 is provided with terminal accommodation chambers 33 for individually accommodating the terminal fittings T and shorting terminal accommodation chambers 35 for accommodating the shorting terminals 10.

The terminal accommodation chambers 33 are divided in a plurality of vertical stages (three stages in this embodiment) and arranged side by side in the lateral direction in each stage. The same number of the terminal accommodation chambers 33 are arranged substantially at the same interval in the lateral direction in each stage.

The terminal fitting T connected to an end part of an unillustrated wire is inserted and accommodated into each terminal accommodation chamber 33 from behind. The terminal fitting T inserted to a proper position into the terminal accommodation chamber 33 is retained by being locked by a locking lance 34 provided in the terminal accommodation chamber 33.

The shorting terminal accommodation chambers 35 are provided below the terminal accommodation chambers 33 in the uppermost stage. Each shorting terminal accommodation chamber 35 is open both forward and rearward, and the shorting terminal 10 can be accommodated thereinto from front. Note that the rear end of the shorting terminal accommodation chamber 35 communicates with a retainer mounting portion 39 to be described later.

Figure 8:
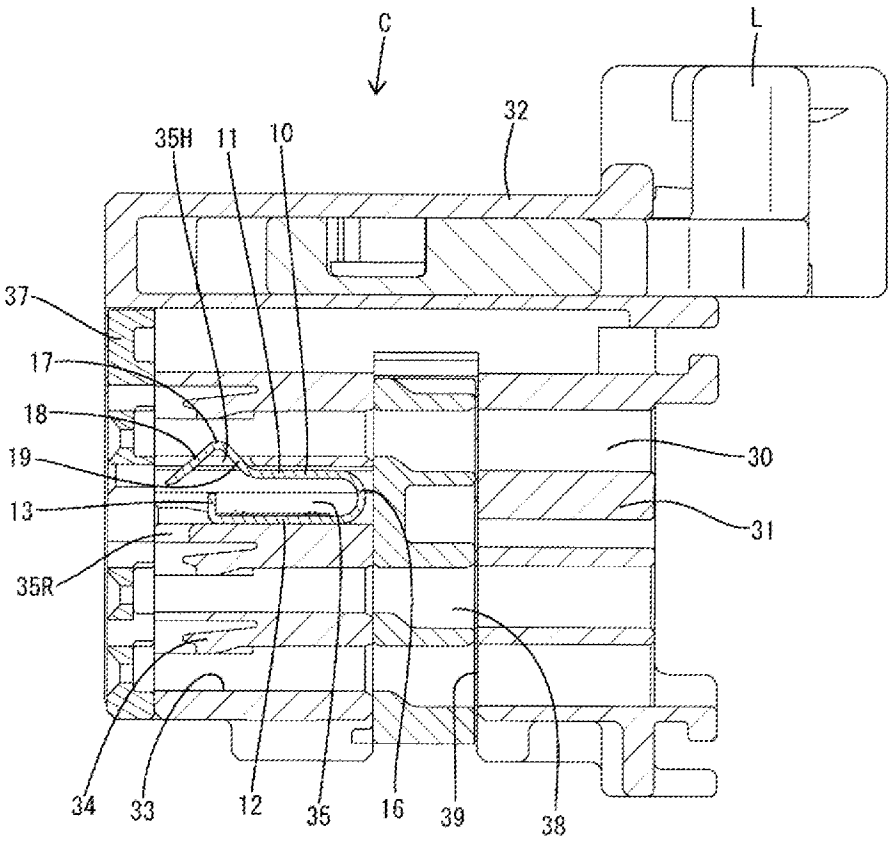
FIG. 8 is a section of the connector.
Figure 10:
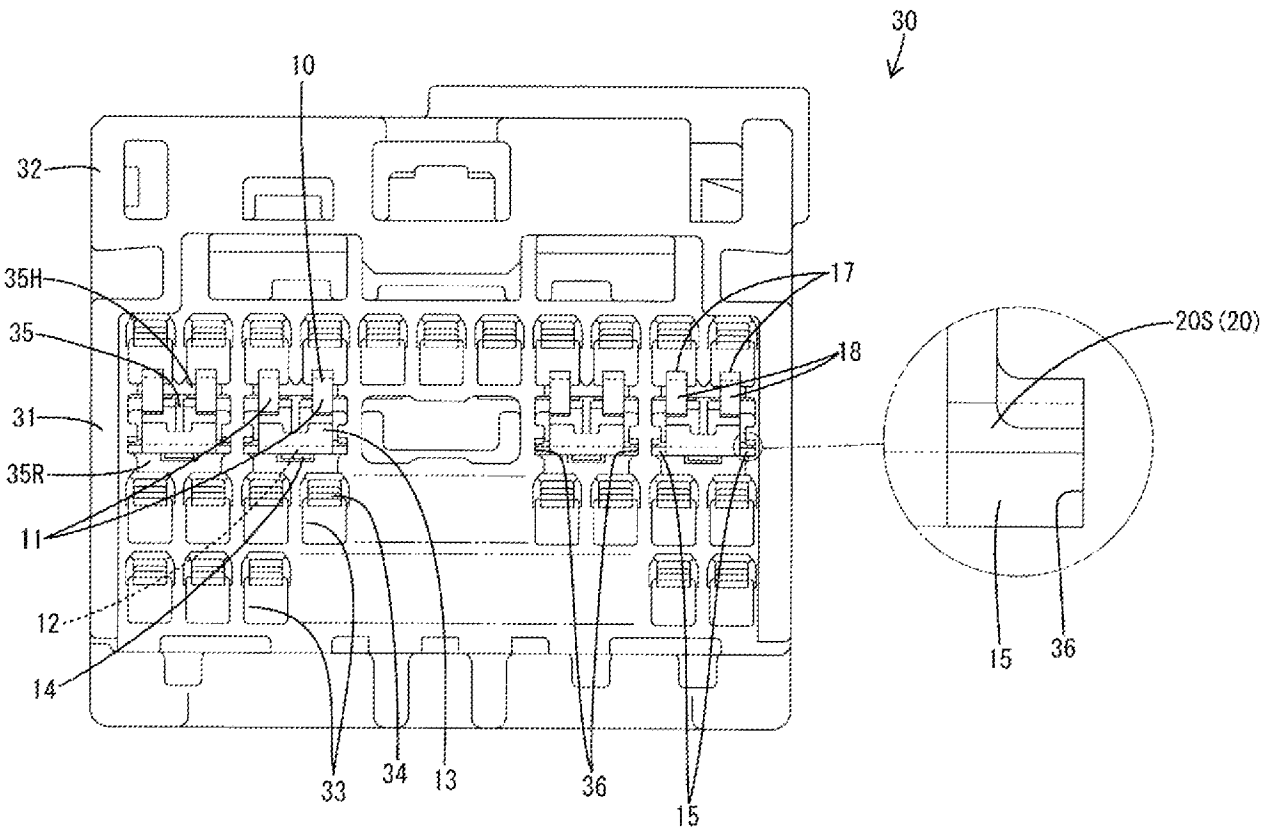
FIG. 10 is a front view showing the housing in a state where the shorting terminals are accommodated.
Figure 11:
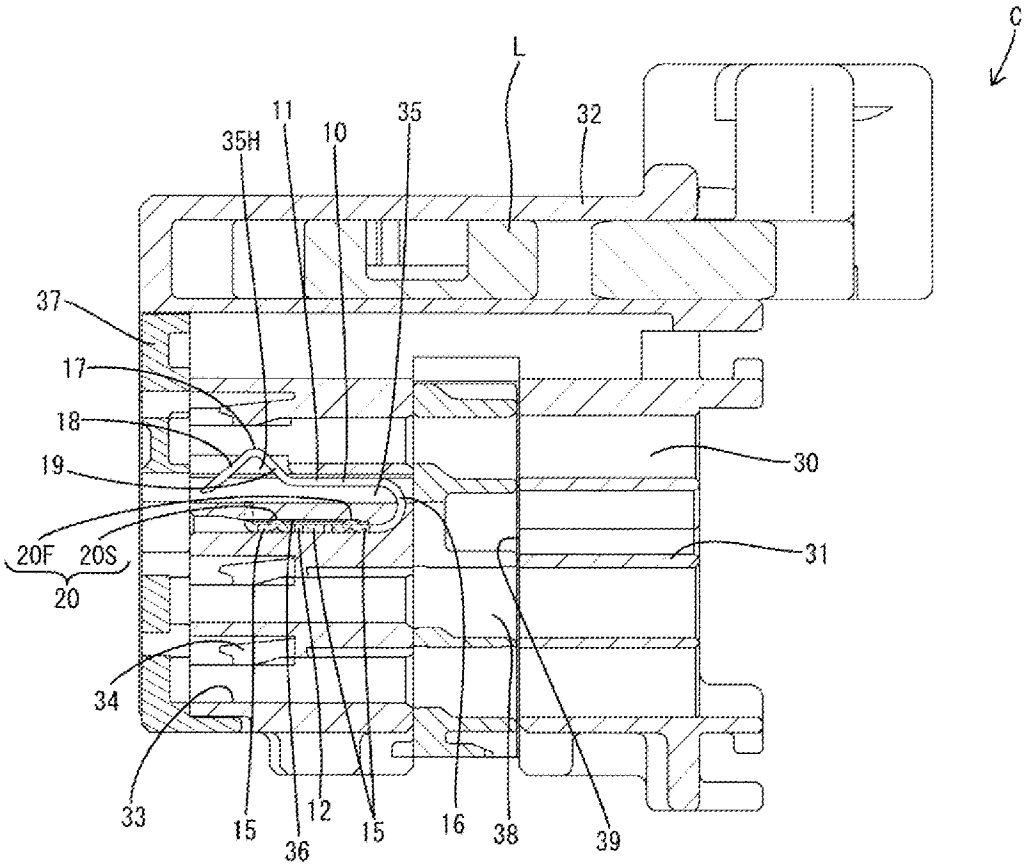
FIG. 11 is a section of the connector showing a state where press-fit projections are press-fit in a press-fit groove.

As shown in FIGS. 8 and 10, an opening 35H is provided on an upper surface side of the shorting terminal accommodation chamber 35 to communicate with a pair of terminal accommodation chambers 33. The contact portions 17 of the resilient contact pieces 11 of the shorting terminal 10 are arranged to project into the terminal accommodation chambers 33 via this opening 35H. Further, an escaping recess 35R for allowing the descending portions 18 of the pair of resilient contact pieces 11 to escape at the time of connection to the mating connector 40 are formed on a lower surface side of the shorting terminal accommodation chamber 35.

Figure 9:
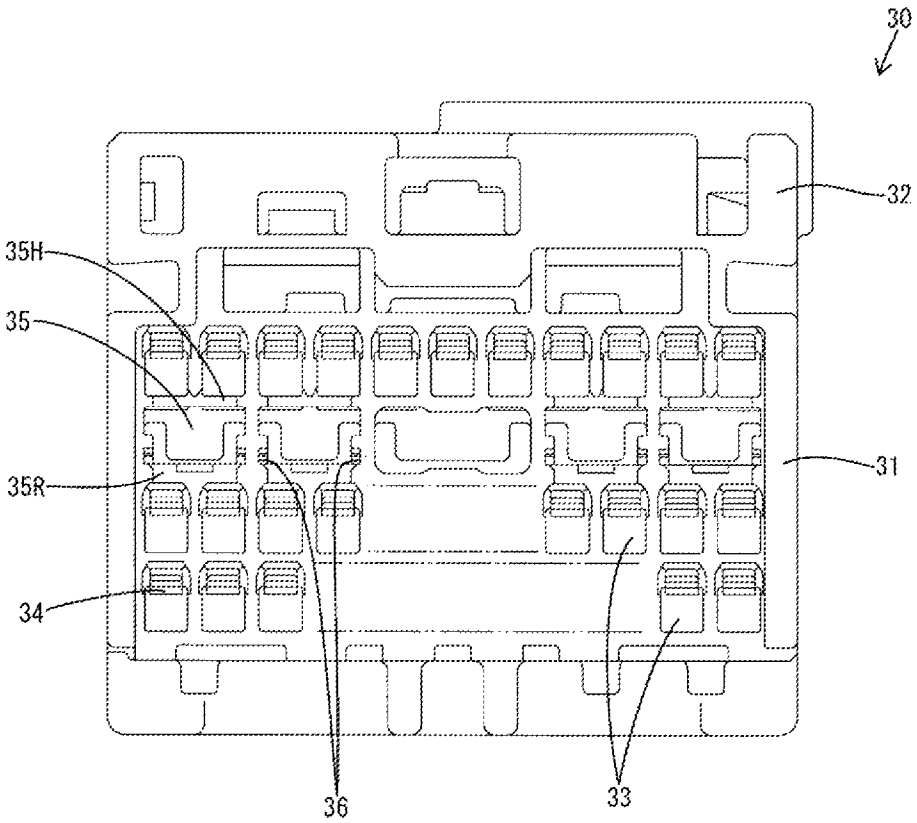
FIG. 9 is a front view showing a housing in a state where a front holder is removed.
Figure 12:
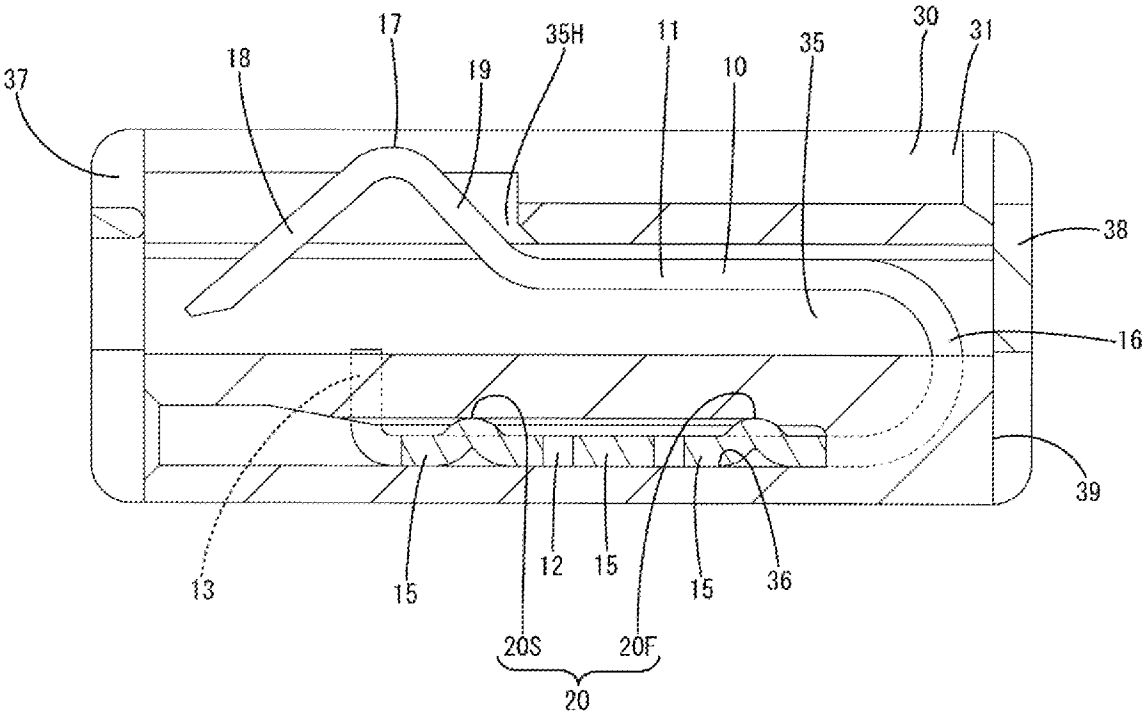
FIG. 12 is a partial enlarged section of FIG. 11 showing the state where the press-fit projections are press-fit in the press-fit groove.
Figure 13:
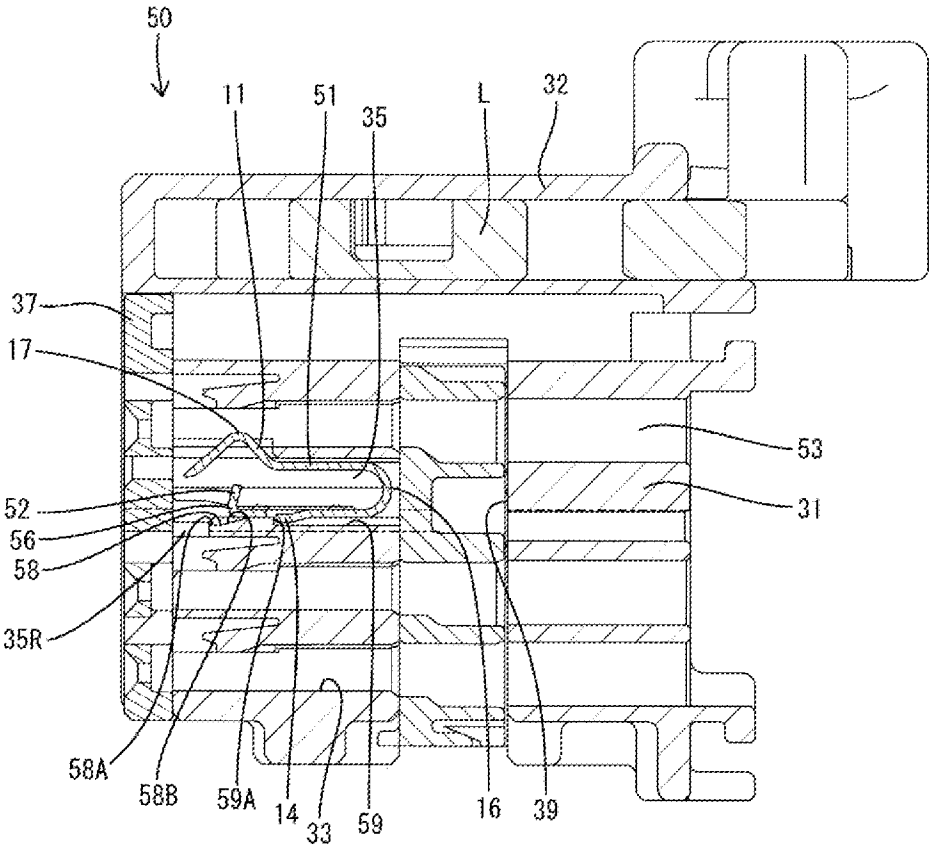
FIG. 13 is a section showing a connector in a second embodiment.

As shown in FIG. 9, both left and right side surfaces of the shorting terminal accommodation chamber 35 are recessed to form the press-fit grooves 36 into which the press-fit projections 20 of the shorting terminal 10 are press-fit. The press-fit groove 36 is formed by being recessed to the left or right along the lower surface of the shorting terminal accommodation chamber 35. As shown in FIG. 12, the press-fit groove 36 is open forward of the terminal accommodating portion 31 and the rear end thereof is closed at a predetermined position.

A back part (part where a first press-fit projection 20F and a second press-fit projection 20S to be described later are press-fit and held) of the press-fit groove 36 has a height (dimension in the vertical direction) substantially constant in the front-rear direction. A height of a front side (left side of FIG. 12) of the press-fit groove 36 is larger than that of the back side (right side of FIG. 12).

A width (dimension in the lateral direction) of the press-fit groove 36 is equal to a width (projecting dimension) of the projecting pieces 15 provided on the both front and rear end parts of the shorting terminal 10 as shown in FIG. 10.

A front holder 37 is mounted in a front surface side of the terminal accommodating portion 31. Front walls of the terminal accommodation chambers 33 and the shorting terminal accommodation chambers 35 are constituted by this front holder 37.

A retainer 38 for locking and secondarily retaining the terminal fittings T is mounted in the terminal accommodating portion 31. The retainer 38 is mounted into the retainer mounting portion 39 provided substantially in a central part of the terminal accommodating portion 31 in the front-rear direction. The retainer mounting portion 39 is open on a lower surface side of the terminal accommodating portion 31 and vertically communicates with the terminal accommodation chambers 33 up to those in the uppermost stage. The retainer 38 mounted into the retainer mounting portion 39 is vertically movable between a partial locking position where parts for locking the terminal fittings T are retracted downwardly from the terminal accommodation chambers 33 and a full locking position where the parts for locking the terminal fittings T are located in the terminal accommodation chambers 33.

The shorting terminal 10 is provided with the press-fit projections 20 to be press-fit into the press-fit grooves 36 provided in the housing 30. As shown in FIG. 4, one press-fit projection 20 is provided on the projecting piece 15 of the shorting terminal 10 and the press-fit projections 20 are arranged on front, rear, left and right sides of the shorting terminal 10. Each press-fit projection 20 projects substantially over the entire area in a width direction in a central part of the corresponding projecting piece 15 in the front-rear direction. Each press-fit projection 20 is rectangular in a plan view.

The press-fit projection 20 projects on an upper surface side of the projecting piece 15 and a recess is formed on a lower surface side of a part of the projecting piece 15 where the press-fit projection 20 is formed (see FIG. 5). The press-fit projection 20 has a dome-shape highest in a central part in the front-rear direction when viewed laterally.

The press-fit projections 20 are separated forwardly and rearwardly from the locking piece 14. A pair of press-fit projections 20 located on front and rear sides in the front-rear direction are press-fit into the same press-fit groove 36. Hereinafter, the press-fit projection located on the rear side of the shorting terminal 10 (front side in a press-fitting direction into the press-fit groove 36) is referred to as the first press-fit projection 20F and the press-fit projection located on the front side (rear side in the press-fitting direction into the press-fit groove 36) is referred to as the second press-fit projection 20S.

The first press-fit grooves 20F and the second press-fit grooves 20S on the both left and right sides of the shorting terminal 10 are respectively provided at the same positions in the front-rear direction. The second press-fit projections 20S are arranged near the contact portions 17 of the resilient contact pieces 11 and located right below the ascending portions 19 as shown in FIG. 5 when the shorting terminal 10 is viewed laterally.

The front and rear press-fit projections 20F, 20S are formed such that a height of the first press-fit projection 20F is smaller than that of the second press-fit projection 20S.

Next, examples of an assembling operation of the connector C and a connecting operation to the mating connector 40 are described.

First, the connector C is assembled.

First, the shorting terminal 10 is mounted into the shorting terminal accommodation chamber 35 of the housing 30 from front. At this time, the first press-fit projections 20F are first inserted into the press-fit grooves 36. Then, the first press-fit projections 20F and the projecting pieces 15 provided with the first press-fit grooves 20F are press-fit into the press-fit grooves 36 and the shorting terminal 10 is inserted and guided to the back of the shorting terminal accommodation chamber 35. As the shorting terminal 10 approaches a proper accommodation position, the second press-fit projections 20S and the projecting pieces 15 provided with the second press-fit grooves 20S are press-fit into the press-fit grooves 36. At this time, since the height of the second press-fit projections 20S is larger than that of the first press-fit grooves 20F, even if the press-fit grooves 36 are pushed and widened by the first press-fit projections 20F, press-fitting margins of the second press-fit projections 20S are secured.

When the shorting terminal 10 reaches the proper accommodation position, the projecting pieces 15 on the rear side reach the rear ends of the press-fit grooves 36 and the shorting terminal 10 is stopped not to move any further rearward as shown in FIG. 12. Further, the contact portions 17 of the pair of resilient contact pieces 11 are arranged to project into the corresponding terminal accommodation chambers 33 through the opening 35H. All the press-fit projections 20 on the front, rear, left and right sides of the shorting terminal 10 are press-fit into the press-fit grooves 36 with sufficient press-fitting margins and vertical rattling is suppressed at all the press-fit projections 20. Note that the locking piece 14 of the shorting terminal 10 is arranged to face forward as shown in FIG. 10.

After the shorting terminals 10 are accommodated into the shorting terminal accommodation chambers 35 in this way, the front holder 37 is mounted. Then, unillustrated lock receiving portions provided on the rear surface of the front holder 37 are locked to the locking pieces 14 of the shorting terminals 10 from front, thereby retaining the shorting terminals 10 so as not to come out forward.

Subsequently, the retainer 38 is mounted into the retainer mounting portion 39 of the housing 30 and held at the partial locking position, and the terminal fitting T is inserted into each terminal accommodation chamber 33 of the housing 30. Each terminal fitting T is locked and retained by the locking lance 34 when reaching a proper insertion depth. Further, the resilient contact pieces 11 of the shorting terminal 10 contact a pair of the terminal fittings T to short these terminal fittings T. Thereafter, the retainer 38 is pushed to the full locking position to secondarily lock each terminal fitting T.

In this way, the assembling operation of the connector C is completed.

Next, the connector C is connected to the mating connector 40.

Figure 2:
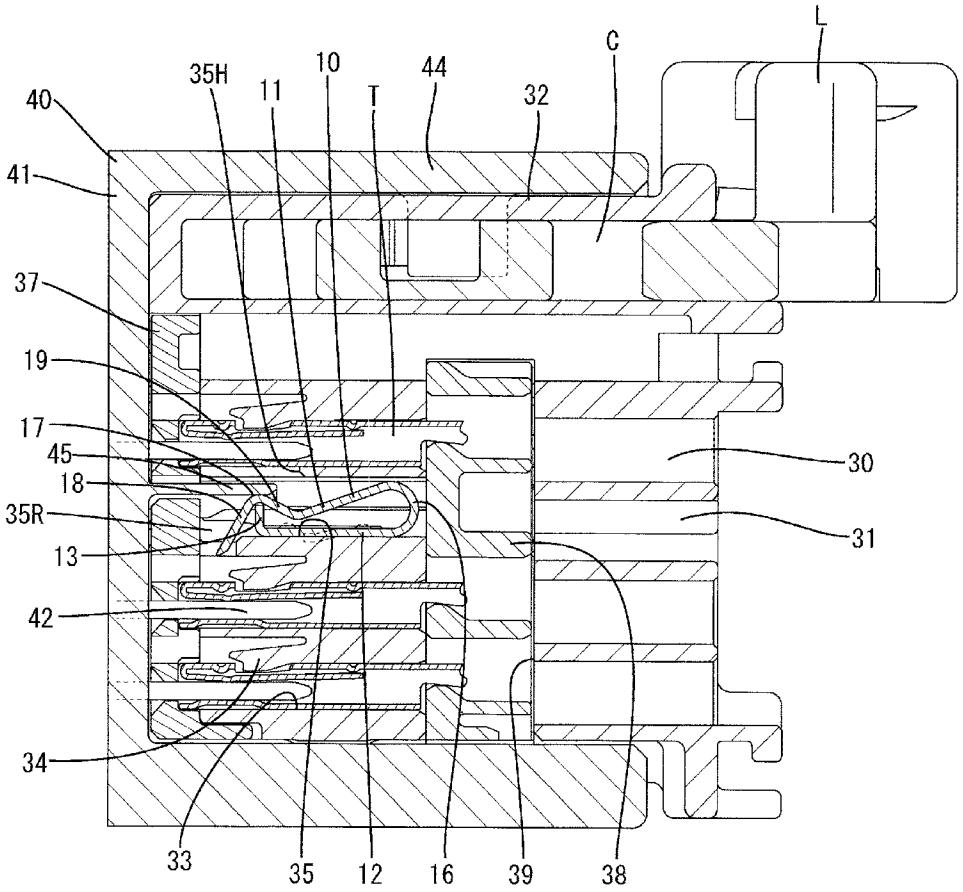
FIG. 2 is a section showing the connector in a state connected to the mating connector.
Figure 3:
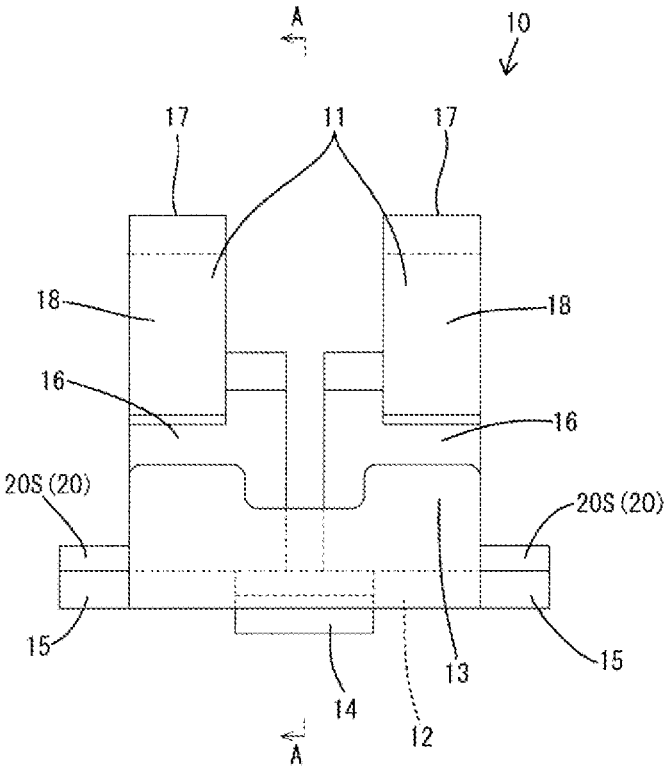
FIG. 3 is a front view of a shorting terminal.

After the housing 30 is shallowly fit into the receptacle 44 of the mating connector 40, the lever L is rotated. Then, as shown in FIG. 2, the both connectors C, 40 reach a properly connected state to conductively connect the terminal fittings T, 42. Further, in conjunction with the connecting operation of the both connectors C, 40, the respective resilient contact pieces 11 are pushed and tilted by the short releasing portions 45 of the mating housing 41 to be separated from the terminal fittings T, thereby releasing the shorted state.

In this way, the connecting operation to the mating connector 40 is completed.

Next, functions and effects of the embodiment configured as described above are described.

The connector C of this embodiment includes the shorting terminals 10 each for shorting the pair of terminal fittings T by the resilient contact pieces 11 resiliently contacting the pair of terminal fittings T and the housing 30 for accommodating the terminal fittings T and the shorting terminals 10. The shorting terminal 10 is provided with a pair of press-fit projections 20 to be press-fit into one press-fit groove 36 provided in the housing 30 and separated in the press-fitting direction into the press-fit groove 36. The pair of press-fit projections 20 are such that the height of the first press-fit projection 20F located on the front side in the press-fitting direction is smaller than that of the second press-fit projection 20S located on the rear side.

According to this configuration, even if the press-fit groove 36 is pushed and widened by the first press-fit projection 20F first entering the press-fit groove 36, the formation of a clearance between the later entering second press-fit projection 20S and the press-fit groove 36 and the like can be prevented. Thus, rattling can be reliably suppressed by both of the pair of press-fit projections 20F, 20S entering the one press-fit groove 36.

Further, the second press-fit projection 20S located on the rear side in the press-fitting direction is arranged near the contact portion 17 of the resilient contact piece 11 to be brought into contact with the terminal fitting T. According to this configuration, rattling can be reliably prevented near the contact portion 17 of the resilient contact piece 11 by the second press-fit projection 20S located on the rear side. Thus, the rattling of the shorting terminal 10 can be effectively suppressed.

Second Embodiment

Next, a connector 50 according to a second specific embodiment of the present invention is described in detail with reference to FIGS. 13 to 17.

The connector 50 of the second embodiment differs from the first embodiment in that a shorting terminal 51 includes a rising portion 52 rising obliquely backward from the front end (rear end in a press-fitting direction) of a base plate 12. Note that the same components as in the first embodiment are denoted by the same reference signs and repeated description is omitted.

The connector 50 in the second embodiment includes, as in the first embodiment, shorting terminals 51 each for shorting a pair of terminal fittings T, and a housing 53 for accommodating the terminal fittings T and the shorting terminals 51.

As in the first embodiment, the shorting terminal 51 is provided with pairs of press-fit projections 20F, 20S to be press-fit into press-fit grooves 36 provided in the housing 53, and a height of first press-fit projections 20F located on a front side in a press-fitting direction is smaller than that of second press-fit projections 20S located on a rear side.

As in the first embodiment, the shorting terminal 51 includes a base plate 12 substantially in the form of a flat plate and a pair of resilient contact pieces 11 folded from the rear end of the base plate 12 and extending forward, and a locking piece 14 to be locked to the housing 53 is formed in a central part of the base plate 12. As in the first embodiment, the resilient contact piece 11 is resiliently deflectable in a vertical direction with a folded portion 16 as a supporting point, and has a larger width on the side of the folded portion 16 than on the side of a contact portion 17.

As in the first embodiment, projecting pieces 15 to be inserted into the press-fit grooves 36 of the housing 53 are provided on both left and right sides of the base plate 12. As in the first embodiment, the projecting pieces 15 are provided on both front and rear end parts and an intermediate part of the base plate 12, and the press-fit projections 20F, 20S project on the projecting pieces 15 provided on the both front and rear end parts of the base plate 12.

As in the first embodiment, the housing 53 includes a terminal accommodating portion 31 for accommodating the terminal fittings T and the shorting terminals 51 and a lever accommodating portion 32 for accommodating a lever L. As in the first embodiment, the terminal accommodating portion 31 is provided with a plurality of terminal accommodation chambers 33 and a plurality of shorting terminal accommodation chambers 35, and a front holder 37 is mounted in a front surface side of the terminal accommodating portion 31.

As in the first embodiment, both left and right side surfaces of the shorting terminal accommodation chamber 35 are recessed to form the press-fit grooves 36 into which the press-fit projections 20 of the shorting terminal 51 are press-fit. As in the first embodiment, the press-fit groove 36 is formed by being recessed to the left or right along the lower surface of the shorting terminal accommodation chamber 35 and is open forward of the terminal accommodating portion 31 and the rear end (hereinafter, referred to as a back end 54) thereof is closed at a predetermined position (see FIG. 17).

Figure 15:
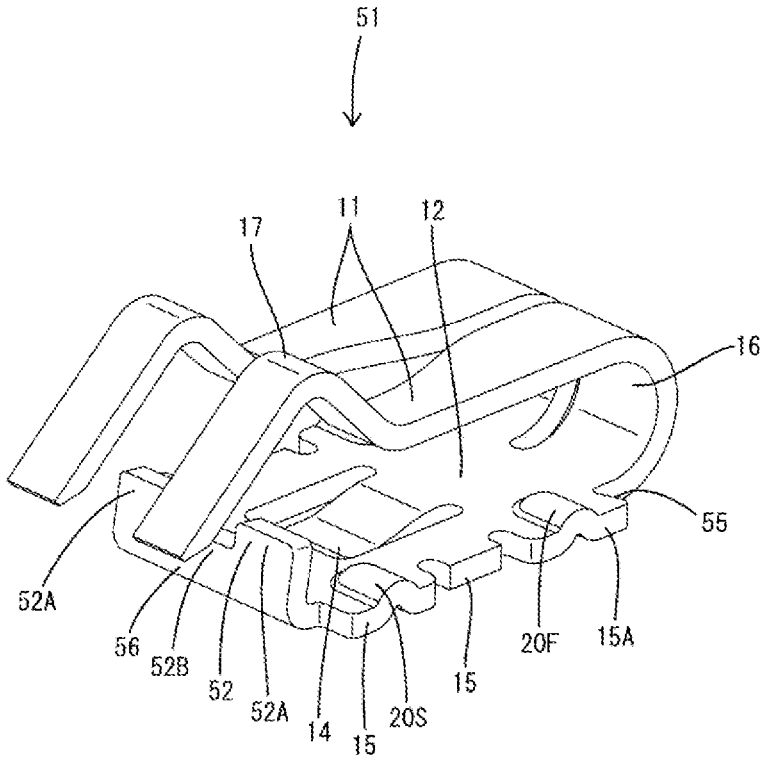
FIG. 15 is a perspective view showing a shorting terminal.

The shorting terminal 51 of the second embodiment includes the rising portion 52 rising upward (direction intersecting with the press-fitting direction) from the front end of the base plate 12 as shown in FIG. 15. The rising portion 52 is slightly inclined rearwardly entirely in width and height directions. A lower side (on the side of the base plate 12) of the rising portion 52 is located slightly more rearward (forward in the press-fitting direction) than an upper side (rising end side).

The rising portion 52 is shaped similarly to the excessive deflection preventing wall 13 of the first embodiment. The rising portion 52 is bent upwardly over the entire width of the base plate 12. The rising portion 52 is located below the resilient contact pieces 11 (at a side opposite to a side to be brought into contact with the terminal fittings T) and prevents excessive deflection of the resilient contact pieces 11 as in the first embodiment.

Figure 14:
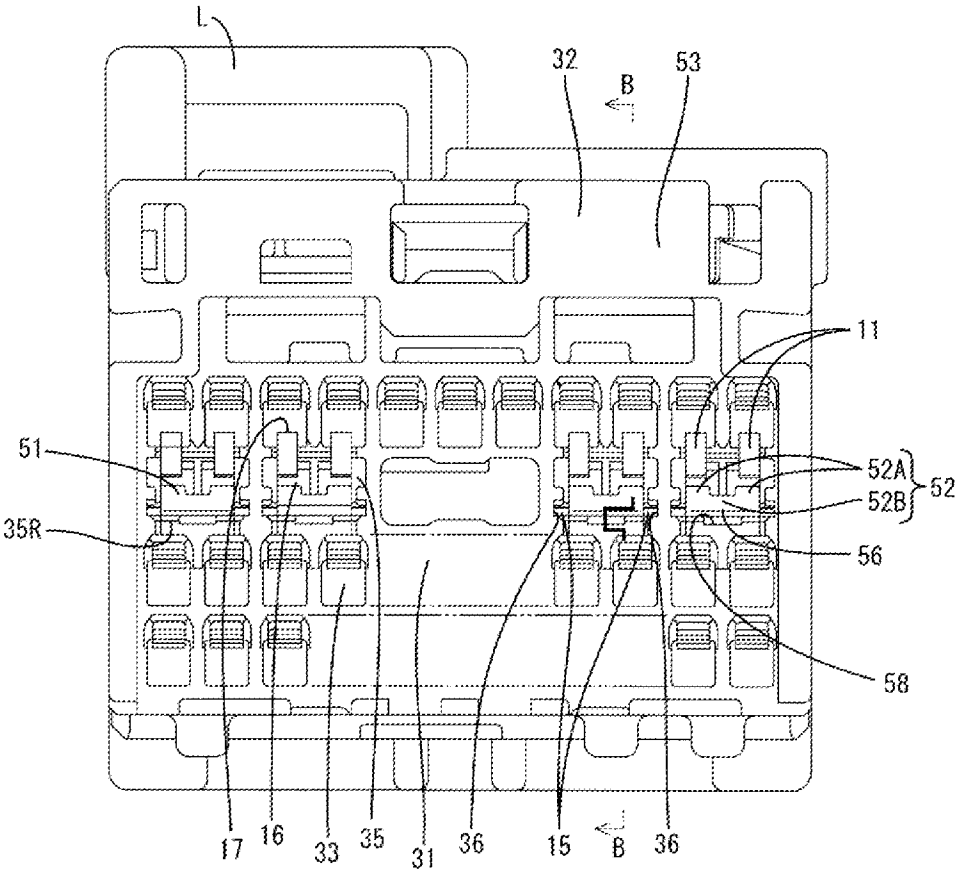
FIG. 14 is a front view showing the connector in a state where a front holder is removed.

Both left and right end parts of the rising portion 52 have a larger height (rising dimension) than a central part. Hereinafter, the both left and right end parts of the rising portion 52 are referred to higher portions 52A and the central part is referred to as a lower part 52B. A height of the lower portion 52B is substantially half the height of the higher portions 52A. The higher portions 52A are located right below the pair of resilient contact pieces 11, and the lower portion 52B is located between the pair of resilient contact pieces 11. As shown in FIG. 14, a width of the higher portion 52A is larger than that of the contact portion 17 of the resilient contact piece 11 and smaller than that of the folded portion 16.

Figure 17:
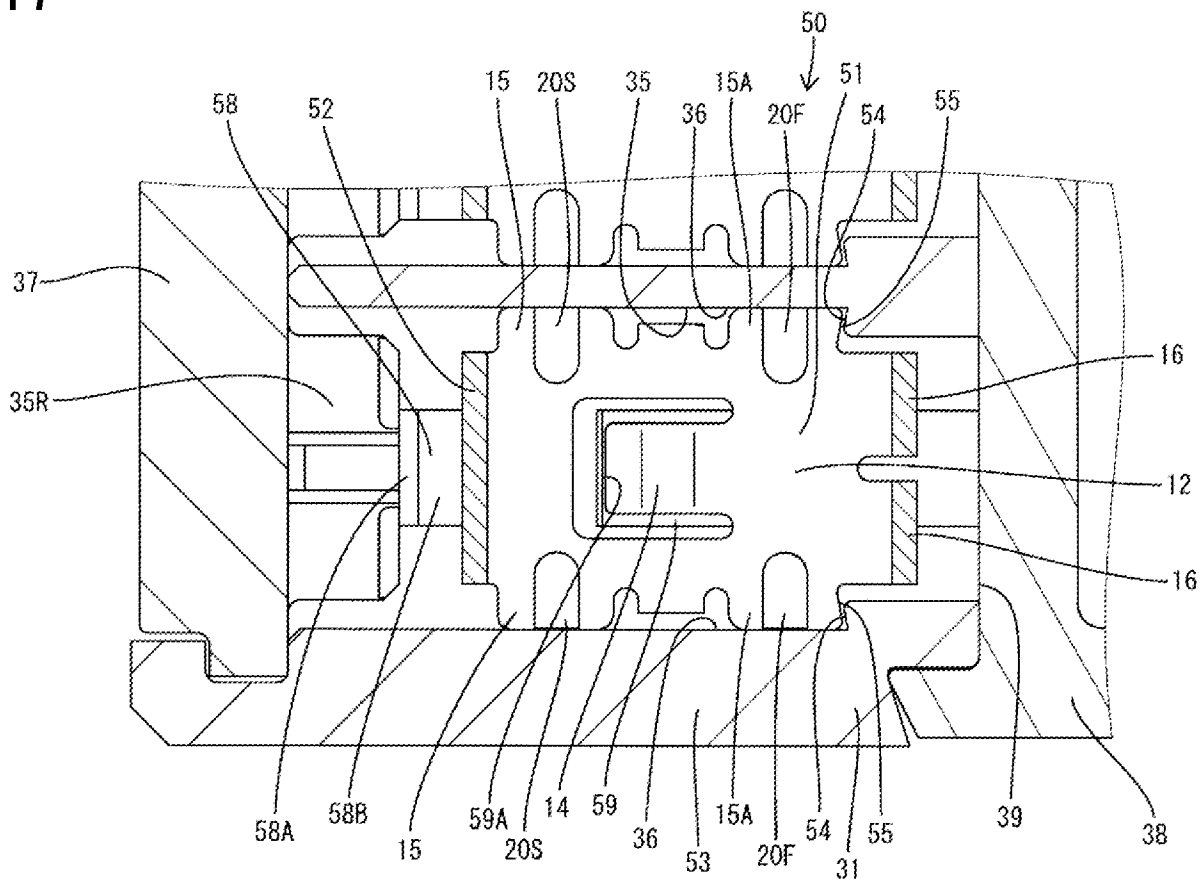
FIG. 17 is a partial enlarged section of the connector showing the shorting terminal accommodated at a proper accommodation position.

Further, the rear edge (front edge in the front-rear direction out of the periphery edge of the projecting piece, hereinafter, referred to as a rear edge 55) of the rear projecting piece 15A out of the projecting pieces 15 is formed into a reverse tapered shape inclined such that an end on an outer side (projecting end side) in a width direction of the shorting terminal 51 is located more rearward (forward in the press-fitting direction) than an end on an inner side (on the side of the base plate 12) as shown in FIG. 17. The rear edge 55 of the rear projecting piece 15A is inclined substantially at a constant gradient over the entire width (entire width in a projecting direction of the projecting piece 15A). Note that both front and rear edges of the projecting pieces 15 provided on the front end part and the intermediate part and the front edges of the rear projecting pieces 15A are substantially at a right angle to the front-rear direction.

When the shorting terminal 51 reaches a proper accommodation position of the shorting terminal accommodation chamber 35, the rear edges of the rear projecting pieces 15A come into contact with the back ends 54 of the press-fit grooves 36.

As shown in FIG. 17, the back end 54 of the press-fit groove 36 is formed into a reverse tapered shape inclined such that an end on an outer side in a width direction of the shorting terminal accommodation chamber 35 is located more rearward (forward in the press-fitting direction) than an end on an inner side (central side). The back end 54 of the press-fit groove 36 has about the same gradient as the rear edge 55 of the rear projecting piece 15A.

A front end part (rear end part in the press-fitting direction) of the shorting terminal accommodation chamber 35 is provided with a recess 58 corresponding to an end part (hereinafter, referred to as a base end part 56) of the rising portion 52 on the side of the base plate 12. The recess 58 is provided behind the escaping recess 35R and formed by recessing a wall surface (lower surface) of the shorting terminal accommodation chamber 35.

The recess 58 has a flat surface 58A expanding substantially horizontally from the rear end of the escaping recess 35R and an inclined surface 58B gradually inclined upwardly toward the rear from the rear end of the flat surface 58A. With the shorting terminal 51 accommodated at the proper accommodation position in the shorting terminal accommodation chamber 35, the front end of the inclined surface 58B of the recess 58 is located in front of the front end of the shorting terminal 51 and the rear end of the recess 58 is located behind the upper end (rising end) of the rising portion 52. Note that a depth at the flat surface 58A of the recess 58 is equal to that of a locking groove 59.

The locking groove 59 is a groove in which the locking piece 14 of the shorting terminal 51 can be locked, and formed to extend forward from a retainer mounting portion 39. The locking piece 14 can be locked to a locking surface 59A formed on the front end of the locking groove 59. The locking groove 59 is formed to have a constant depth.

The recess 58 is provided in a central part of the shorting terminal accommodation chamber 35 in the width direction (see FIG. 14). A width of the recess 58 is equal to an interval in the width direction between the pair of resilient contact pieces 11, and larger than the width of the lower portion 52B of the rising portion 52.

Next, an example of an operation of accommodating the shorting terminal 51 of the second embodiment into the shorting terminal accommodation chamber 35 of the housing 53 is described.

Figure 16:
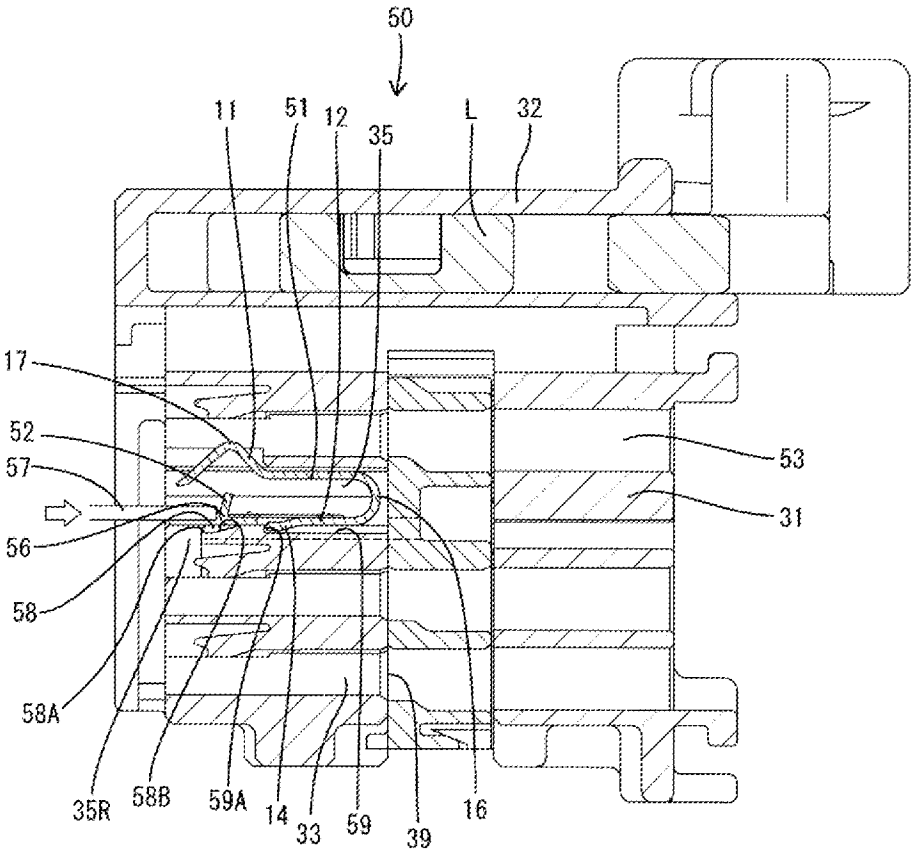
FIG. 16 is a section, corresponding to a cross-section at position B-B of FIG. 14, showing a state where the shorting terminal is accommodated in a housing.

The shorting terminal 51 is accommodated into the shorting terminal accommodation chamber 35 by being pressed by a jig 57 in an assembling facility (see FIG. 16). The jig 57 presses the base end part 56 of the rising portion 52. When the shorting terminal 51 is pushed into the housing 53, the first and second press-fit projections 20F, 20S successively enter the press-fit grooves 36 as in the first embodiment. Further, the locking piece 14 of the shorting terminal 51 is gradually resiliently deflected upwardly by the inclined surface 58B of the recess 58.

As the shorting terminal 51 approaches the proper accommodation position, a tip part of the jig 57 reaches the front end part of the shorting terminal accommodation chamber 35. Since the front end part of the shorting terminal accommodation chamber 35 is provided with the recess 58, the tip part of the jig 57 contacts the wall surface of the shorting terminal accommodation chamber 35 and presses the base end part 56 of the rising portion 62 without being displaced upward.

When the shorting terminal 51 reaches the proper accommodation position, the rear edges 55 of the rear projecting pieces 15A come into contact with the back ends 54 of the press-fit grooves 36 from front to be positioned as shown in FIG. 17. Further, as shown in FIG. 16, the locking piece 14 reaches the locking groove 59 and resiliently returns to lock the locking surface 59A from behind. This causes the shorting terminal 51 to be held in a state accommodated at the proper accommodation position of the shorting terminal accommodation chamber 35. In this way, the accommodating operation of the shorting terminal 51 is completed.

As described above, in the second embodiment, the height of the first press-fit projection 20F located on the front side in the press-fitting direction is smaller than that of the second press-fit projection 20S located on the rear side as in the first embodiment. Thus, rattling can be reliably suppressed by both of the pair of press-fit projections 20F, 20S entering one press-fit groove 36.

Further, the shorting terminal 51 includes the base plate 12 in the form of a flat plate having the press-fit projections 20F, 20S and the rising portion 52 rising upward from the front end of the base plate 12, and the rising portion 52 is inclined such that the upper side is located more rearward than the lower side. According to this configuration, the shorting terminal 51 can be accommodated into the housing 53 by pressing the base end part 56 of the rising portion 52 with the jig 57.

Here, for example, if an upper part of the rising portion is pressed with the jig, it is difficult to accurately control the push-in amount of the shorting terminal since the rising portion is easily deformed to tilt rearwardly. However, since the base end part 56 of the rising portion 52 of the second embodiment is difficult to deform even if being pressed by the jig 57, the push-in amount of the shorting terminal 51 can be easily controlled.

In addition, since the jig 57 presses the base end part 56 of the rising portion 52 near the base plate 12, a pressing force of the jig 57 efficiently acts on the base plate 12. Thus, the press-fit projections 20F, 20S provided on the projecting pieces 15 on the both sides of the base plate 12 can be efficiently press-fit.

Further, there is conventionally known a shorting terminal in which a box portion to be pressed by a jig is provided to surround resilient contact pieces. However, since the shorting terminal 51 needs not be provided with a box portion according to the configuration described above, material cost can be reduced.

Further, the recess 58 is provided on the front end part of the shorting terminal accommodation chamber 35 to correspond to the base end part 56 of the rising portion 52. Here, if no recess is formed on the front end part of the shorting terminal accommodation chamber, the tip part of the jig 57 easily contacts the wall surface of the shorting terminal accommodation chamber and it is difficult to bring the jig 57 into contact with the base end part 56 of the rising portion 52. However, since the tip part of the jig 57 can enter the recess 58 according to the configuration of the second embodiment, the base end part 56 of the rising portion 52 can be pressed reliably.

Further, the rising portion 52 is located below the resilient contact pieces 11 and prevents excessive deflection of the resilient contact pieces 11. According to this configuration, since the rising portion 52 has an excessive deflection prevention function, the shape of the shorting terminal 51 can be simplified as compared to the case where an excessive deflection preventing portion is separately provided in the shorting terminal 51.

Further, the rear edges 55 of the rear projecting pieces 15A come into contact with the back ends 54 of the press-fit grooves 36 to position the shorting terminal 51, and are inclined such that the outer ends in the width direction of the shorting terminal 51 are located more rearward than the inner ends. According to this configuration, the rear edges 55 of the rear projecting pieces 15A come into point contact with the back ends 54 of the press-fit grooves 36 to position the shorting terminal 51. Thus, the shorting terminal 51 can be more accurately positioned since points of contact are clear, for example, as compared to the case where the entire rear edges of the rear projecting pieces come into contact with the back ends of the press-fit grooves.

Further, the back end 54 of the press-fit groove 36 is inclined such that the outer end in the width direction of the shorting terminal accommodation chamber 35 is located more rearward than the inner end. According to this configuration, since the rear projecting piece 15A is less likely to be separated from the back end 54 of the press-fit groove 36, it can be prevented that the shorting terminal 51 is inserted beyond the proper accommodation position (the push-in amount of the shorting terminal 51 becomes excessive).

The invention is not limited to the above described and illustrated first and second embodiments. For example, the following embodiments are also included in the technical scope of the present invention.

Although the present invention is applied to a case where the shorting terminal 10 is accommodated into the housing 30 from front in the above first embodiment, there is no limitation to this and the present invention can also be applied to a case where the shorting terminal is inserted, for example, laterally into the housing.

Although the shorting terminal 10 includes the resilient contact pieces 11 supported on one end in the above first embodiment, the shorting terminal may include resilient contact pieces supported on both ends in the present invention.

Although the shorting terminal 10 is provided in the female connector C accommodating the female terminal fittings T in the above first embodiment, there is no limitation to this and the present invention can also be applied to a case where a shorting terminal is provided in a male connector accommodating male terminal fittings.

Although the press-fit projections 20 project on the projecting pieces 15 separated on the front and rear sides of the shorting terminal 10 in the above first embodiment, there is no limitation to this and the press-fit projections may project on front and rear end parts of a projecting piece continuous in the front-rear direction.

Although the recess 58 is formed on the front end part of the shorting terminal accommodation chamber 35 in the above second embodiment, the recess may not necessarily be provided.

Although the rising portion 52 is located below the resilient contact pieces 11 to prevent excessive deflection of the resilient contact pieces 11 in the above second embodiment, there is no limitation to this and, for example, the rising portion may be located in front of the resilient contact pieces and have no excessive deflection prevention function.

Although the rear edge 55 of the rear projecting piece 15A is formed into a reverse tapered shape in the above second embodiment, the shape of the rear edge 55 may not necessarily be a reverse tapered shape.

Although the back end 54 of the press-fit groove 36 is formed into a reverse tapered shape in the above second embodiment, the shape of the back end 54 may not necessarily be a reverse tapered shape.

LIST OF REFERENCE SIGNS

C, 50 . . . connector
T terminal fitting
10, 51 . . . shorting terminal
11 . . . resilient contact piece
12 . . . base plate
15 . . . projecting piece
17 . . . contact portion
20 . . . press-fit projection
20F . . . first press-fit projection (press-fit projection located on front side in press-fitting direction)
20S . . . second press-fit projection (press-fit projection located on rear side in press-fitting direction)
30, 53 . . . housing
35 . . . shorting terminal accommodation chamber
36 . . . press-fit groove
52 . . . rising portion
54 . . . back end of press-fit groove
55 . . . rear edge (front edge in press-fitting direction out of peripheral edge of projecting piece)
56 . . . base end part (end part on base plate side)
58 . . . recess

The invention claimed is:

1. A connector, comprising:

a shorting terminal including a resilient contact piece and configured to short a pair of terminal fittings by the resilient contact piece resiliently contacting the pair of terminal fittings; and a housing configured to accommodate the terminal fittings and the shorting terminal;

wherein:

the shorting terminal includes a pair of press-fit projections to be press-fit into one press-fit groove provided in the housing, the press-fit projections being separated on front and rear sides in a press-fitting direction into the press-fit groove;

the pair of press-fit projections are formed such that a height of the press-fit projection located on the front side in the press-fitting direction is smaller than that of the press-fit projection located on the rear side;

the shorting terminal includes a base plate in the form of a flat plate having the press-fit projections, and a rising portion rising in a direction intersecting with the press-fitting direction from a rear end of the base plate in the press-fitting direction;

the rising portion is inclined such that a rising end side is located more forward than a base plate side in the press-fitting direction;

the housing includes a shorting terminal accommodation chamber configured to accommodate the shorting terminal; and a recess is provided on a rear end part of the shorting terminal accommodation chamber in the press-fitting direction to correspond to an end part of the rising portion on the base plate side.

2. A The connector of claim 1, wherein the press-fit projection located on the rear side in the press-fitting direction, out of the pair of press-fit projections, is arranged near a contact portion of the resilient contact piece configured to contact the terminal fittings.

3. The connector of claim 1, wherein the rising portion is located at a side of the resilient contact piece opposite to a side to be brought into contact with the terminal fittings and prevents excessive deflection of the resilient contact piece.

4. The connector of claim 3, wherein:

the shorting terminal includes a projecting piece projecting on the base plate and to be inserted into the press-fit groove;

a front edge in the press-fitting direction, out of a peripheral edge of the projecting piece, comes into contact with a back end of the press-fit groove to position the shorting terminal; and the front edge of the projecting piece is inclined such that an end on a projecting end side is located more forward than an end on the base plate side in the press-fitting direction.

5. The connector of claim 4, wherein:

the shorting terminal includes a projecting piece projecting on the base plate and to be inserted into the press-fit groove; and a back end of the press-fit groove is inclined such that an outer end in a width direction of the shorting terminal accommodation chamber is located more forward than an inner end in the press-fitting direction.

6. The connector of claim 1, wherein the rising portion is located at a side of the resilient contact piece opposite to a side to be brought into contact with the terminal fittings and prevents excessive deflection of the resilient contact piece.

7. The connector of claim 1, wherein:

the shorting terminal includes a projecting piece projecting on the base plate and to be inserted into the press-fit groove;

a front edge in the press-fitting direction, out of a peripheral edge of the projecting piece, comes into contact with a back end of the press-fit groove to position the shorting terminal; and the front edge of the projecting piece is inclined such that an end on a projecting end side is located more forward than an end on the base plate side in the press-fitting direction.

8. The connector of claim 1, wherein:

the shorting terminal includes a projecting piece projecting on the base plate and to be inserted into the press-fit groove; and a back end of the press-fit groove is inclined such that an outer end in a width direction of the shorting terminal accommodation chamber is located more forward than an inner end in the press-fitting direction.

* * * * *